US006302807B1

(12) United States Patent
Rohrer

(10) Patent No.: US 6,302,807 B1
(45) **Date of Patent: *Oct. 16, 2001**

(54) GOLF CLUB HEAD WITH VARIABLE ENERGY ABSORPTION

(76) Inventor: John W. Rohrer, 49 Long Cove Rd., York, ME (US) 03909

( * ) Notice: Subject to any disclaimer, the term of this patent is extended or adjusted under 35 U.S.C. 154(b) by 0 days.

This patent is subject to a terminal disclaimer.

(21) Appl. No.: 09/323,744

(22) Filed: Jun. 1, 1999

(51) Int. Cl.[7] ..... A63B 53/04

(52) U.S. Cl. ..... 473/329; 473/340; 473/342; 473/350; 473/332

(58) Field of Search ..... 473/324, 329, 473/330, 331, 332, 333, 347, 348, 349, 350, 342, 340, 219, 226, 236, 282, 238

(56) References Cited

U.S. PATENT DOCUMENTS

| | | | |
|---|---|---|---|
| 3,211,455 | * | 10/1965 | Hyden . |
| 3,578,332 | | 5/1971 | Caldwell . |
| 3,679,207 | | 7/1972 | Florian . |
| 4,156,526 | | 5/1979 | Huggins et al. . |
| 4,422,638 | | 12/1983 | Tucker . |
| 5,058,895 | | 10/1991 | Igarashi . |
| 5,078,398 | | 1/1992 | Reed et al. . |
| 5,083,778 | | 1/1992 | Douglas . |
| 5,405,136 | * | 4/1995 | Hardman . |
| 5,407,196 | | 4/1995 | Busnardo . |
| 5,489,094 | * | 2/1996 | Pritchett . |
| 5,529,543 | * | 6/1996 | Beaumont . |
| 5,766,093 | | 6/1998 | Rohrer . |
| 6,001,030 | * | 12/1999 | Delaney . |

OTHER PUBLICATIONS

Pelz, Dave, *GOLF Magazine*: 64 (Aug. 1994).

* cited by examiner

*Primary Examiner*—Sebastiano Passaniti
(74) *Attorney, Agent, or Firm*—Kevin M. Farrell

(57) ABSTRACT

Disclosed is a golf club head, preferably a putterhead, comprising a striking face with an intended strikepoint, and a variable energy absorbing means incorporated such that maximum energy is absorbed when a golf ball is struck on the intended strikepoint and progressively less energy is absorbed as the ball is struck on the striking face at distances incrementally remote from the intended strikepoint along a horizontal axis. In preferred embodiments, the energy absorbing elements are comprised of a plurality of adjacent viscoelastic elements of predetermined and varying energy absorption. The adjacent viscoelastic elements are arranged such that energy absorption is greatest at the intended strikepoint, the plurality of adjacent viscoelastic elements cooperating to reduce the variance of, and optimally to equalize, the distance a golf ball travels when struck at the intended strikepoint, or points on the striking face remote from the intended strikepoint, with an otherwise identical stroke.

28 Claims, 1 Drawing Sheet

GOLF CLUB HEAD WITH VARIABLE ENERGY ABSORPTION

BACKGROUND OF THE INVENTION

Golfers and club designers have long recognized the advantages of clubs and putters with such undefined characteristics as "good feel" and "enlarged sweetspots." Some putter designers have used such methods as severe toe and heel weighting (creating high rotational moments of inertia around the putterhead center of gravity) to slightly reduce, but not eliminate, the effects of mishits on distance loss. "Mishits" as used herein occur when the actual ball strikepoint on the putter face occurs at some distance from the intended strikepoint. Others have used a uniform milled or cast slot behind the putterhead striking face to improve feel on mishits. However, such designs provide little or no actual distance loss improvement. Still others have used metalic or non-metalic inserts generally made with face materials as hard as or harder than a golf ball or golf ball cover (thus conforming with United States Golf Association (USGA) rules) which absorb impact vibrations thereby improving feel, again without improvement in mishit distance loss. Such inserts may have softer material behind the relatively hard face.

Scientific test results on popular putters using a putting robot were published in 1994 (Pelz, *Golf Magazine* 8/94: 64–65). This study quantified large distance losses resulting from mishits on the striking face. Toe/heel average distance loss for a ⅜ inch mishit on a 27 foot putt ranged from 2.85 feet (10.55%) for the worst designs (classical blades) to 1.85 feet (6.85%) for better designs (mallet head). It was determined through such testing that doubling the mishit distance (e.g., to ¾ inch) approximately tripled the observed distance loss.

Golfers are, to a large extent, generally unaware of their average and maximum mishits during a round of golf. Large mishits are more likely on longer putts and, unfortunately, lead to the greatest percentage distance loss just when it is most critical to get the ball close to the hole to avoid 3 putt greens. It has been reported (Pelz, *Golf Magazine* 9/95: 64–65) that ¾ inch mishits were not uncommon among average players and even accomplished players often have mishits greater than ⅜ inch. This data was determined through the use of impact decals affixed to the strikingface of putterheads.

None of the prior art putterhead designs eliminate or substantially reduce distance loss associated with mishit putts. A putterhead design which minimizes the distance loss associated with mishit putts would represent a substantial improvement in putterhead design. In addition, although Applicant is unaware of published test results conducted with golf clubs other than putters, the principles discussed above in connection with putters is equally applicable to other golf clubs (e.g., woods, irons and utility clubs).

SUMMARY OF THE INVENTION

The present invention relates to a golf club head, preferably a putterhead, comprising a striking face with an intended strikepoint, and a variable energy absorbing means incorporated such that maximum energy is absorbed when a golf ball is struck on the intended strikepoint and progressively less energy is absorbed as the ball is struck on the striking face at distances incrementally remote from the intended strikepoint along a horizontal axis.

In preferred embodiments, the energy absorbing means is comprised of a plurality of adjacent viscoelastic elements of predetermined and varying energy absorption. The adjacent viscoelastic elements are arranged such that energy absorption is greatest at the intended strikepoint, the plurality of adjacent viscoelastic elements cooperating to reduce the variance of, and optimally to equalize, the distance a golf ball travels when struck at the intended strikepoint, or points on the striking face remote from the intended strikepoint, with an otherwise identical stroke.

DESCRIPTION OF PREFERRED EMBODIMENTS

Figure 1:
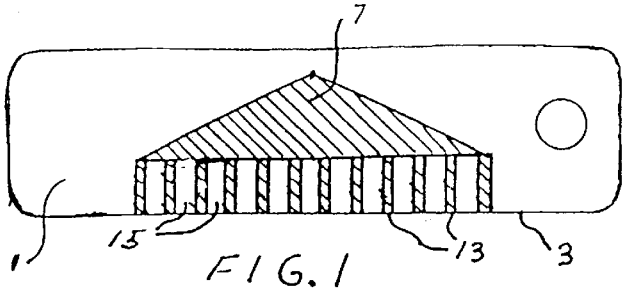
FIG. 1 is a top cross-sectional view of a putterhead of the present invention wherein a single viscoelastic material is in communication with the striking face of the putterhead through a plurality of generally vertically oriented rigid striking elements separated by small voids or elastic or viscoelastic material.

The subject invention relates to a golf club head which reduces or eliminates mishit distance loss. While the discussion which follows is directed primarily toward the putter, it will be recognized that the principles apply and are applicable to all golf clubs (e.g., woods (including metal woods), irons, and utility clubs such as chippers).

Golf putterheads are designed with an intended strikepoint on the striking face of the club. The intended strikepoint is defined as that point at which ball travel distance is maximized when balls are struck at constant velocity. This point (more precisely, a vertical line) is found between the putterhead center of gravity and the putter shaft longitudinal axis. As stated above, it is generally recognized that mishits (i.e., putts in which the golf ball is struck at a point other than the intended strikepoint on the striking face) result in distance loss. The present invention reduces or eliminates the detrimental effects of distance loss by incorporating an energy absorbing means in the putterhead.

More specifically, the present invention relates to a putterhead which incorporates a variable energy absorbing means. The variable energy absorbing means is designed such that maximum energy is absorbed as the ball is struck on the intended strikepoint (or along the vertical line which includes the intended strikepoint), and progressively less energy is absorbed as the ball is struck further from the intended strikepoint along a horizontal axis within the "working section" of the striking face. While the working section can, of course, encompass the entire striking face, in preferred embodiments the working section is general ±½ inch to ±1 inch on either side of the intended strikepoint. In a preferred embodiment, the working section extends fully to the base of the putterhead so that any mishits low on the striking face are subject to distance correction as well.

The variable energy absorbing embodiments specifically described herein utilize concurrent putterhead striking face deflection and energy absorption (i.e., the tendency of the striking face to slightly deflect upon contact with a golf ball and absorb energy) to reduce or eliminate the distance loss problems associated with mishit putts. In general, embodiments which exhibit striking face deflection and energy absorption can be designed using one or more viscoelastic elastomer materials incorporated into the design. Some elastomers are highly viscoelastic, absorbing energy well, while others (even of comparable flexibility and hardness) are more purely elastic and absorb much less energy.

As will be discussed in detail below, embodiments of the present invention include putterheads in which variable energy absorbing elements make direct contact with a golf ball cover when the golf ball is struck, as well as embodiments in which a single face plate is used to cover and protect the adjacent viscoelastic elements or enhance the sound or feel of ball impact. Also disclosed are embodiments in which multiple rigid striking elements cover and protect viscoelastic elements. In embodiments in which a face plate is used, the adjacent viscoelastic elements do not make direct contact with the golf ball cover. With respect to embodiments in which at least one of the adjacent viscoelastic elements makes direct contact with the golf ball cover, preferred contact elastomeric materials have a hardness which is generally greater than the hardness of a golf ball cover (e.g., 87 Shore A scale durometer hardness). This is not a requirement, however, and direct elastomer contact embodiments in which the contact elastomer is less hard than a golf ball cover are operative and fall within the scope of the present invention.

In embodiments in which a non-integral face plate is used, the plurality of adjacent viscoelastic elements may be comprised of a viscoelastic material which is either softer, or harder than a golf ball cover.

The effect of incorporating the energy absorbing means in the putterhead design is that balls struck on the intended strikepoint encounter maximum energy absorption, whereas balls struck at points on the striking face other than the intended strikepoint encounter progressively less energy absorption at distances incrementally remote from the intended strikepoint along a horizontal axis (i.e., toward the heel or the toe). The net effect of this design is that balls struck with a substantially identical putterhead velocity travel substantially the same distance irrespective of the point on the striking face where the ball is contacted.

In preferred embodiments, the putterhead of the present invention contains a working section which absorbs energy in a variable manner. The working section contains a centrally located strikepoint on a striking face and a plurality (i.e., two or more) of adjacent viscoelastic elements of predetermined and varying energy absorption. The viscoelastic materials from which the adjacent viscoelastic elements are made are selected, shaped and arranged such that energy absorption is greatest when a golf ball is struck at the intended strikepoint. The boundary between adjacent viscoelastic materials may be straightline or curvalinear. The rear boundary between the adjacent viscoelastic elements and the rigid putterhead blank may be straightline (i.e., parallel to the striking face) or curvalinear. Alternatively, the plurality of adjacent viscoelastic elements may protrude through the back of the putterhead (see, e.g., FIGS. 2 and 3). Less energy is absorbed if a golf ball is struck at a point incrementally remote from the intended strikepoint along a horizontal axis.

Consider, for example, a thin vertical section taken from a putterhead of the present invention (see, e.g., FIGS. 3, 4 and 6) in a plane perpendicular to the striking face of the putterhead. If the plurality of adjacent viscoelastic materials of a particular working section is comprised of two elastomer species, the elastomer species which absorbs energy to a greater degree than the other species will account for a greater volume of this section if it is taken from a central portion of the working section, at or near the intended strikepoint. If, on the other hand, such a vertical section is take from a point in the working section which is incrementally remote from the strikepoint (i.e., toward the heel or the toe of the putterhead) the percentage volume occupied by the elastomer species which absorbs greater energy decreases, relative to the volume occupied by the same elastomer species in a centrally located thin vertical section.

While the drawings referred to herein represent a classical "blade" design, the overall shape of the putterhead is not critical with respect to embodiments of the present invention. For example, the design of the putterhead of the present invention can be a conventional "blade" design, a toe and heel weighted design or an asymmetrical "mallet" design. The body of the putterhead can be made of any of the currently employed materials (e.g., brass, stainless steel, aluminum, graphite, ceramics, wood, resins, etc.).

In FIG. 1, viscoelastic material of variable thickness (7) is in communication with the striking face (3) of the putterhead (1) through a plurality of vertically oriented striking elements (15). The major plane of the vertically oriented striking elements is perpendicular to the striking face (3) of the putterhead. The striking elements are comprised of a rigid material (e.g., brass, stainless steel, resin, etc.) and the widths of the striking elements (from front to back and side to side) can be fixed or variable. In a preferred embodiment, the vertically oriented striking elements (15) are insulated from adjacent vertically oriented striking elements by an elastomeric material (13). Alternatively, the viscoelastic material (7) can also be used as the insulating material (13). As with other embodiments of the present invention, viscoelastic material (7) may be replaced with a composite of adjacent viscoelastic materials.

Figure 2:
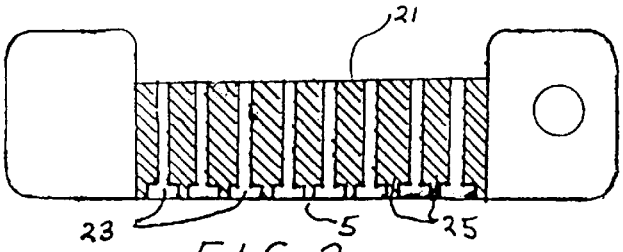
FIG. 2 is a top cross-sectional view of a putterhead of the present invention wherein the variable energy absorbing means comprises the viscoelastic layers between a plurality of generally vertically oriented rigid striking elements, said elements being of constant or variable length with a void space or open back behind said elements, allowing greatest deflection and energy absorption at the center.

Referring to FIG. 2, the viscoelastic material behind the striking face described in connection with the embodiment of FIG. 1 can be replaced with a void or open back cavity (21). The striking elements (23) are insulated from adjacent elements by one or more types of viscoelastic material (25) which provides all of the variable energy absorption in a sheer mode. A ball striking near the intended strikepoint creates more sheer deformation of the viscoelastic insulating layers and, therefore, more energy absorption than a ball struck more remotely.

Figure 3:
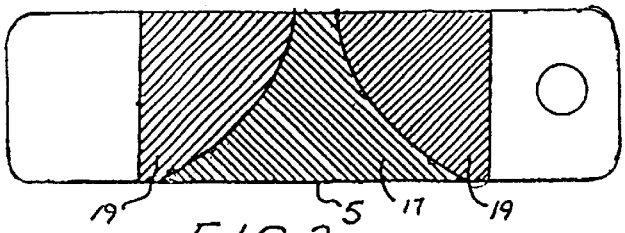
FIG. 3 is a top cross-sectional view of a putterhead of the present invention wherein variable energy absorption is effected by arranging a plurality of adjacent viscoelastic elements to effect the desired energy absorption (greatest at center). In the embodiment shown, a golf ball would actually make direct contact with the surface of at least one member of the plurality of adjacent viscoelastic elements.
Figure 4:
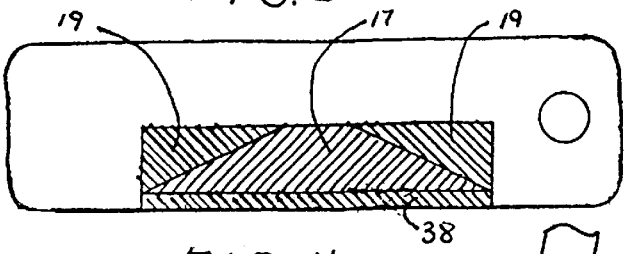
FIG. 4 is a top cross-sectional view of a putterhead of the present invention wherein variable energy absorption is effected by arranging a plurality of adjacent viscoelastic elements molded, cast or bonded behind a non-integral face plate. The plurality of adjacent viscoelastic elements and the non-integral face plate are contained within a rigid putterhead blank.

Variable energy absorption can also be accomplished by laminating, molding, or casting, elastomers having differing energy absorption properties to form an insert with a plurality of adjacent viscoelastic materials of varying viscoelasticity. Referring to FIG. 3, the putterhead is comprised of a first viscoelastic element (17) comprised of a first viscoelastic material, and a set of second energy absorbing elements (19) comprised of a second viscoelastic material flanking the first viscoelastic material. In this embodiment, maximum energy absorption at the intended striking point (5), is accomplished by selecting the first viscoelastic material (17) such that it exhibits greater energy absorption than the second (19). The total number of adjacent viscoelastic elements can be variable. In addition, the individual viscoelastic materials which comprise the plurality of adjacent viscoelastic materials can be of varying width (side to side) and thickness (front to back). For example, FIG. 4 shows an alternative embodiment wherein the plurality of adjacent viscoelastic materials (17 and 19) are shown with the same width as in the embodiment of FIG. 3, however the thickness has been reduced substantially. Insert thickness can be uniform (see, e.g., FIG. 4) or variable (see, e.g., FIG. 6). In preferred embodiments, the insert thickness is greatest behind the intended strikepoint.

As mentioned previously, the boundary between adjacent viscoelastic materials may be sloped (FIG. 4) or perpendicular to the striking face and straightline and/or curvalinear (FIG. 3).

FIG. 4 shows a protective, flexible, face plate (38), preferably made of a material (e.g., metal, plastic elastomer or wood) of 87 Shore A durometer or harder. This face plate can be cast, molded, bonded or laminated to the adjacent insert materials in any of the inserts described and illustrated herein.

Figure 5:
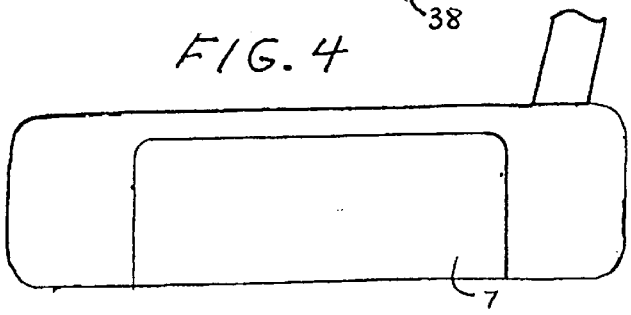
FIG. 5 is a front view of a putterhead of the present invention wherein any energy absorbing system of the present invention, as well as any optional face plate, is surrounded fully at the top and two sides to protect the elements comprising the energy absorbing system from accidental damage. In the embodiment shown, the energy absorbing system extends fully to the base of the putterhead to provide distance loss correction for any putts misstruck in both a horizontal and vertical plane (i.e., low on the striking face).

For additional protection or for enhanced appearance, the energy absorbing inserts of the present invention can be fully or partially surrounded by a rigid putterhead material (37) as illustrated in FIG. 5. In FIG. 5, the rigid putterhead material (37) is eliminated from the bottom of the putterhead thereby extending the working section to the putterhead base thereby preserving the distance correction feature in situations in which a mishit along a vertical axis takes place (low hit on striking face).

Figure 6:
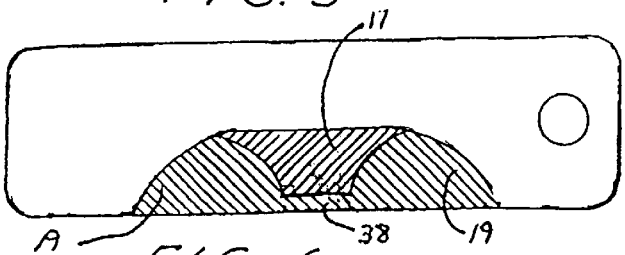
FIG. 6 is a top cross-sectional view of a putterhead of the present invention in which one member of the plurality of adjacent viscoelastic elements also functions as an integral face plate.

FIG. 6 shows an integral face plate (38) which is cast or molded of the same material as one of the adjacent viscoelastic elements (19), in this case, the more lively material (i.e., the viscoelastic which absorbs less energy relative to the other). This embodiment offers manufacturing advantages in terms of relative simplicity and cost. It will be recognized that the boundary between adjacent viscoelastic elements may be effectively sloped in either two possible directions (compare FIG. 6 with FIGS. 3 and 4).

What is claimed is:

1. A putterhead comprising a working section which absorbs energy in a variable manner, the working section containing a centrally located intended strikepoint on a striking face, and comprising a plurality of adjacent viscoelastic elements of predetermined and varying energy absorption, energy absorption being greatest at the intended strikepoint, the plurality of adjacent viscoelastic elements cooperating to equalize the distance a golf ball travels when struck at the intended strikepoint, or points on the striking face remote from the intended strikepoint, with an otherwise identical stroke.

2. The putterhead of claim 1 wherein the striking face comprises the surface of at least one element of the plurality of adjacent viscoelastic elements.

3. A putterhead of claim 2 wherein the rear boundary between the adjacent viscoelastic elements and a putterhead blank is either straightline or curvilinear.

4. The putterhead of claim 1 wherein the striking face is a face plate which is in communication with, and covers, the plurality of adjacent viscoelastic elements.

5. The putterhead of claim 4 wherein the face plate is produced from a material selected from the group consisting of metal, plastic and elastomer.

6. The putterhead of claim 5 wherein the metal is magnesium.

7. The putterhead of claim 5 wherein the face plate is produced from an elastomer which is substantially identical to an elastomeric component of the plurality of viscoelastic elements which is minimally energy absorbing.

8. The putterhead of claim 1 wherein the plurality of adjacent viscoelastic elements meet at a boundary which is straight line or curvilinear.

9. The putterhead of claim 8 wherein the straightline or curvalinear boundary between viscoelastic elements is not perpendicular to the striking face plate.

10. A putterhead of claim 1 wherein the rear boundary between the adjacent viscoelastic elements and a putterhead blank is either straightline or curvilinear.

11. A putterhead comprising a striking face with an intended strikepoint, and a variable energy absorbing means incorporated such that maximum energy is absorbed when a golf ball is struck on the intended strikepoint and progressively less energy is absorbed as the ball is struck on the striking face at distances incrementally remote from the intended strikepoint along a horizontal axis, the variable energy absorbing means comprising a plurality of vertically oriented striking elements, the major plane of the vertically oriented striking elements being oriented perpendicular to the striking face of the putterhead, the vertically oriented striking elements being insulated from communication with adjacent vertically oriented striking elements by one or more viscoelastic energy absorbing materials.

12. An golf club comprising a working section which absorbs energy in a variable manner, the working section containing a centrally located intended strikepoint on a striking face, and comprising a plurality of adjacent viscoelastic elements of predetermined energy absorption varying from a maximum at the intended strikepoint to a minimum at a point in spaced apart relation to the intended strikepoint, the plurality of adjacent viscoelastic elements cooperating to equalize the distance a golf ball travels when struck at the intended strikepoint, or points on the striking face remote from the intended strikepoint, with an otherwise identical stroke.

13. The golf club of claim 12 wherein the striking face comprises the surface of at least one element of the plurality of adjacent viscoelastic elements.

14. The golf club of claim 12 wherein the striking face is a face plate which is in communication with, and covers, the plurality of adjacent viscoelastic elements.

15. The golf club of claim 14 wherein the face plate is produced from a material selected from the group consisting of metal, plastic and elastomer.

16. The golf club of claim 15 wherein the metal is magnesium.

17. The golf club of claim 15 wherein the face plate is produced from an elastomer which is substantially identical to an elastomeric component of the plurality of viscoelastic elements which is minimally energy absorbing.

18. The golf club of claim 12 wherein the plurality of adjacent viscoelastic elements meet at a boundary which is straight line or curvilinear.

19. The golf club of claim 18 wherein the straightline or curvalinear boundary between viscoelastic elements is not perpendicular to the striking face plate.

20. The golf club of claim 12 wherein the rear boundary between the adjacent viscoelastic elements and an iron blank is either straightline or curvilinear.

21. A putterhead comprising a working section which absorbs energy in a variable manner, the working section containing a centrally located intended strikepoint on a striking face, and comprising a plurality of adjacent viscoelastic elements of predetermined and varying energy absorption, energy absorption being greatest at the intended strikepoint, the plurality of adjacent viscoelastic elements cooperating to reduce the variance of the distance a golf ball travels when struck at the intended strikepoint, or points on the striking face remote from the intended strikepoint, with an otherwise identical stroke.

22. The putterhead of claim 21 wherein the striking face comprises the surface of at least one element of the plurality of adjacent viscoelastic elements.

23. The putterhead of claim 21 wherein the striking face is a face plate which is in communication with, and covers, the plurality of adjacent viscoelastic elements.

24. The putterhead of claim 23 wherein the face plate is produced from a material selected from the group consisting of metal, plastic and elastomer.

25. The putterhead of claim 24 wherein the metal is magnesium.

26. The putterhead of claim 24 wherein the face plate is produced from an elastomer which is substantially identical to an elastomeric component of the plurality of viscoelastic elements which is minimally energy absorbing.

27. The putterhead of claim 21 wherein the plurality of adjacent viscoelastic elements meet at a boundary which is straight line or curvilinear.

28. The putterhead of claim 27 wherein the straightline or curvalinear boundary between viscoelastic elements is not perpendicular to the striking face plate.

* * * * *